US011482365B2

(12) United States Patent
Shiga et al.

(10) Patent No.: US 11,482,365 B2
(45) Date of Patent: Oct. 25, 2022

(54) MULTILAYER COIL COMPONENT

(71) Applicant: TDK CORPORATION, Tokyo (JP)

(72) Inventors: Yuto Shiga, Tokyo (JP); Yoji Tozawa, Tokyo (JP); Masaki Takahashi, Tokyo (JP); Takashi Endo, Tokyo (JP); Hajime Kato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 340 days.

(21) Appl. No.: 16/854,303

(22) Filed: Apr. 21, 2020

(65) Prior Publication Data

US 2020/0357557 A1 Nov. 12, 2020

(30) Foreign Application Priority Data

May 7, 2019 (JP) ..... JP2019-087803

(51) Int. Cl.
*H01F 17/00* (2006.01)
*H01F 27/29* (2006.01)

(52) U.S. Cl.
CPC ..... *H01F 17/0013* (2013.01); *H01F 27/292* (2013.01)

(58) Field of Classification Search
CPC .... H01F 17/0013; H01F 27/292; H01F 17/02; H01F 27/28; H01F 27/324; H01F 2027/2809
USPC ..... 336/200
See application file for complete search history.

(56) References Cited

U.S. PATENT DOCUMENTS

| | | | | |
|---|---|---|---|---|
| 11,024,455 | B2 * | 6/2021 | Sekiguchi | H01F 17/0013 |
| 11,222,743 | B2 * | 1/2022 | Yoneda | H01F 17/0013 |
| 2016/0141102 | A1 * | 5/2016 | Tseng | H01F 27/292 336/200 |
| 2017/0103848 | A1 * | 4/2017 | Yoneda | H01F 17/0013 |
| 2018/0358169 | A1 * | 12/2018 | Nishikawa | H01F 27/292 |
| 2019/0096569 | A1 * | 3/2019 | Tanabe | H01F 41/041 |

FOREIGN PATENT DOCUMENTS

JP 2017-73536 A 4/2017

* cited by examiner

*Primary Examiner* — Dharti H Patel
(74) *Attorney, Agent, or Firm* — Oliff PLC

(57) ABSTRACT

A multilayer coil component 1 includes an element body 2 having a plurality of stacked insulator layers 6 and having an outer surface provided with recessed portions 7 and 8, a coil 9 disposed in the element body 2, and terminal electrodes 4 and 5 connected to the coil 9 and disposed in the recessed portions 7 and 8. The recessed portions 7 and 8 are defined by a bottom surface and a side surface extending in a depth direction of the recessed portions 7 and 8 over the outer surface and the bottom surface, the terminal electrodes 4 and 5 have a first surface facing the bottom surface and a second surface facing the side surface, and a connection region A where a compound of elements constituting the element body 2 and a metal component are mixed is exposed to the second surface.

4 Claims, 11 Drawing Sheets

MULTILAYER COIL COMPONENT

TECHNICAL FIELD

The present invention relates to a multilayer coil component.

BACKGROUND

The multilayer coil component that is described in, for example, Patent Literature 1 (Japanese Unexamined Patent Publication No. 2017-73536) is known as a multilayer coil component of the related art. The multilayer coil component described in Patent Literature 1 includes an element body, a coil disposed in the element body, and a pair of terminal electrodes embedded in a recessed portion of the element body and disposed over an end surface and a mounting surface of the element body.

SUMMARY

In a configuration in which a terminal electrode is embedded in a recessed portion of an element body as in the multilayer coil component of the related art, the adhesion part between a side surface of the recessed portion and the terminal electrode is likely to be a starting point of peeling. Accordingly, when peeling occurs at the adhesion part between a side surface of the recessed portion and the terminal electrode in the multilayer coil component of the related art, peeling may serially occur at other contact parts. As a result, in the multilayer coil component of the related art, the terminal electrode may peel off from the element body.

An object of one aspect of the present invention is to provide a multilayer coil component with which peeling of a terminal electrode can be suppressed.

A multilayer coil component according to one aspect of the present invention includes an element body having a plurality of stacked insulator layers and having an outer surface provided with a recessed portion, a coil disposed in the element body, and a terminal electrode connected to the coil and disposed in the recessed portion. The recessed portion is defined by a bottom surface and a side surface extending in a depth direction of the recessed portion over the outer surface and the bottom surface, the terminal electrode has a first surface facing the bottom surface and a second surface facing the side surface, and a connection region where a compound of elements constituting the element body and a metal component are mixed is exposed to the second surface.

In the multilayer coil component according to one aspect of the present invention, the connection region where a compound of elements constituting the element body and a metal component are mixed is exposed on the second surface of the terminal electrode. In this manner, in the multilayer coil component, the surface of the terminal electrode that comes into contact with the side surface of the recessed portion of the element body contains a compound of elements constituting the element body, and thus the adhesion strength between the connection region and the element body is improved. Accordingly, in the multilayer coil component, the adhesion strength between the recessed portion of the element body and the second surface of the terminal electrode is improved. Accordingly, in the multilayer coil component, it is possible to suppress the occurrence of peeling at the adhesion part between the side surface of the recessed portion of the element body and the terminal electrode. As a result, peeling of the terminal electrode can be suppressed in the multilayer coil component.

In one embodiment, the connection region may be exposed to the second surface positioned in both end portions of the terminal electrode in a direction in which the plurality of insulator layers are stacked. In this configuration, the adhesion strength between the second surface positioned in both end portions of the terminal electrode and the element body is improved. Accordingly, peeling of the terminal electrode can be further suppressed in the multilayer coil component.

In one embodiment, the connection region may be exposed to the first surface. In this configuration, the adhesion strength between the element body and the first surface of the terminal electrode as well as the adhesion between the element body and the second surface is improved. Accordingly, peeling of the terminal electrode can be further suppressed in the multilayer coil component.

According to one aspect of the present invention, peeling of a terminal electrode can be suppressed.

DETAILED DESCRIPTION

Figure 1:
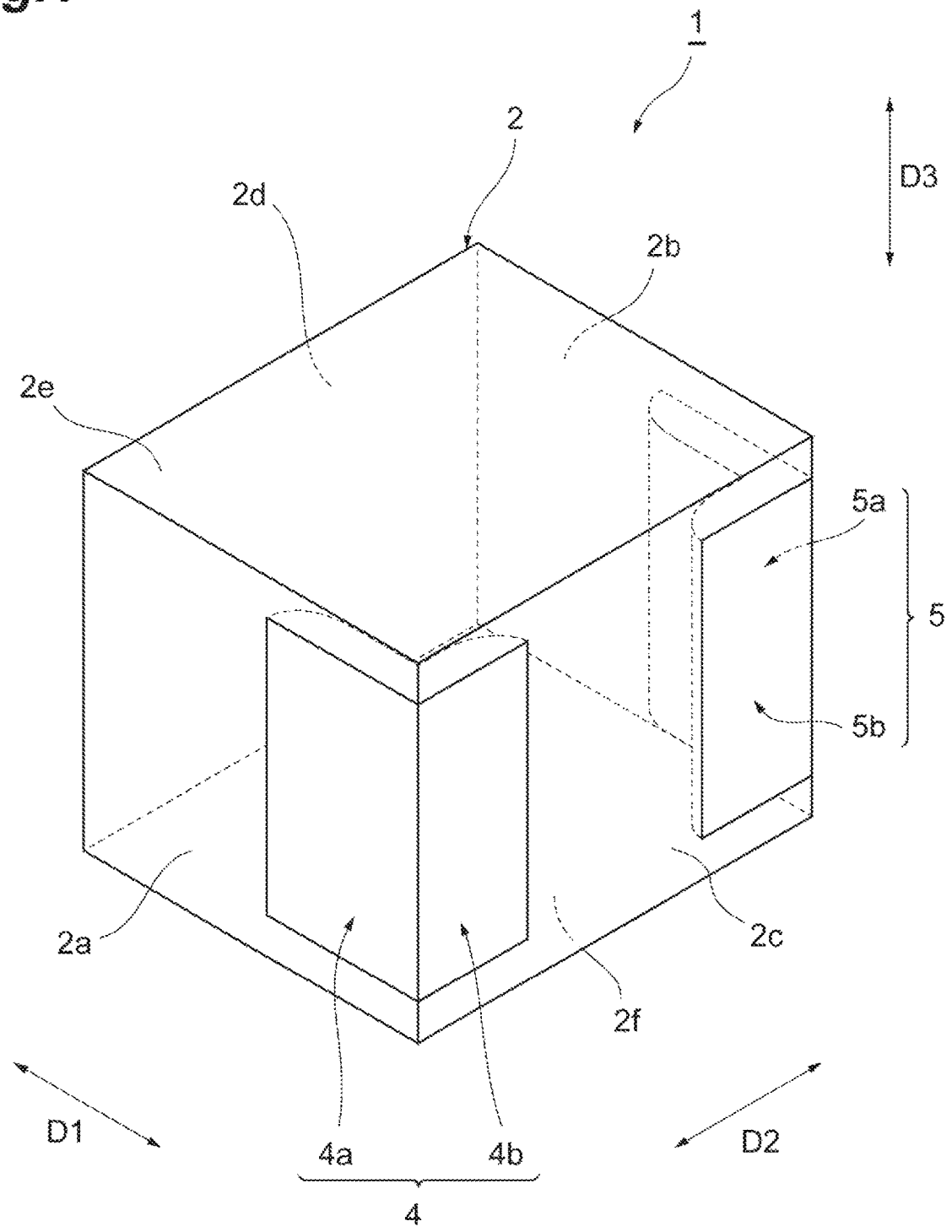
FIG. 1 is a perspective view of a multilayer coil component according to a first embodiment.

Hereinafter, preferred embodiments of the present invention will be described in detail with reference to the accompanying drawings. It should be noted that the same or equivalent elements will be denoted by the same reference numerals and redundant description will be omitted in the description of the drawings.

First Embodiment

As illustrated in FIG. 1, a multilayer coil component 1 is provided with an element body 2 having a rectangular parallelepiped shape and a pair of terminal electrodes 4 and 5. The pair of terminal electrodes 4 and 5 are respectively disposed in both end portions of the element body 2. The rectangular parallelepiped shape includes a rectangular parallelepiped shape in which a corner portion and a ridge line portion are chamfered and a rectangular parallelepiped shape in which a corner portion and a ridge line portion are rounded.

The element body 2 has a pair of end surfaces 2*a* and 2*b* facing each other, a pair of main surfaces 2*c* and 2*d* facing each other, and a pair of side surfaces 2*e* and 2*f* facing each other. The direction in which the pair of main surfaces 2*c* and 2*d* face each other, that is, the direction that is parallel to the end surfaces 2*a* and 2*b* is a first direction D1. The direction in which the pair of end surfaces 2*a* and 2*b* face each other, that is, the direction that is parallel to the main surfaces 2*c* and 2*d* is a second direction D2. The direction in which the pair of side surfaces 2*e* and 2*f* face each other is a third direction D3. In the present embodiment, the first direction D1 is the height direction of the element body 2. The second direction D2 is the longitudinal direction of the element body 2 and is orthogonal to the first direction D1. The third direction D3 is the width direction of the element body 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the third direction D3, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the second direction D2, that is, the long side direction of the pair of end surfaces 2*a* and 2*b*. The multilayer coil component 1 is, for example, solder-mounted on an electronic device (such as a circuit board and an electronic component). In the multilayer coil component 1, the main surface 2*c* constitutes a mounting surface facing the electronic device.

Figure 2:
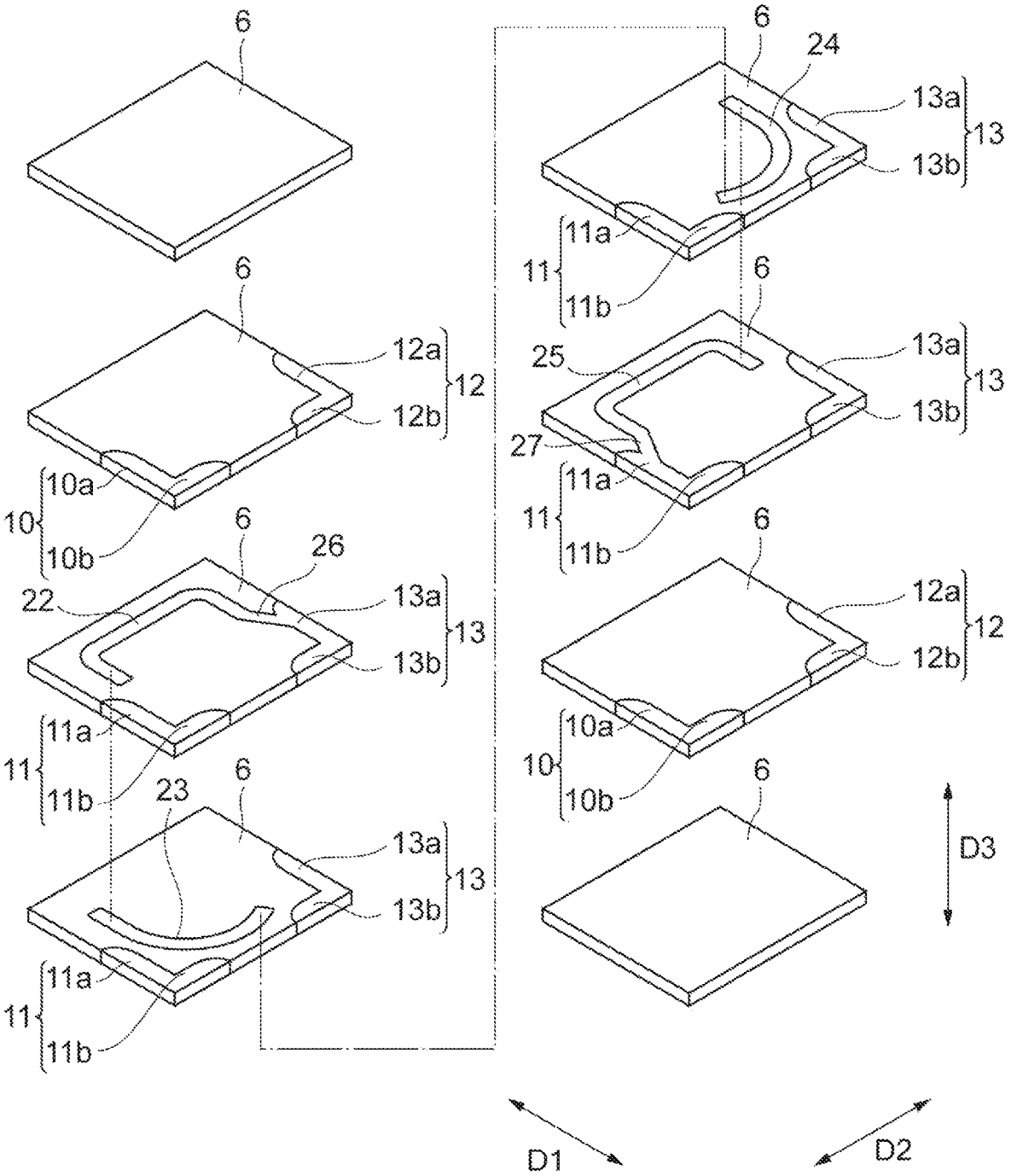
FIG. 2 is an exploded perspective view of an element body of the multilayer coil component of FIG. 1.

As illustrated in FIG. 2, the element body 2 is configured by a plurality of insulator layers 6 being stacked in the third direction D3. The element body 2 has the plurality of insulator layers 6 that are stacked. In the element body 2, the direction in which the plurality of insulator layers 6 are stacked coincides with the third direction D3. In the actual element body 2, each insulator layer 6 is integrated to the extent that the boundaries between the insulator layers 6 are invisible.

Each insulator layer 6 is formed of a dielectric material containing a glass component. In other words, the element body 2 contains a dielectric material containing a glass component as a compound of elements constituting the element body 2. The glass component is, for example, borosilicate glass. The dielectric material is, for example, $BaTiO_3$-based dielectric ceramic, $Ba(Ti, Zr)O_3$-based dielectric ceramic, or $(Ba, Ca)TiO_3$-based dielectric ceramic. A sintered body of a ceramic green sheet containing a glass ceramic material constitutes each insulator layer 6.

Figure 3:
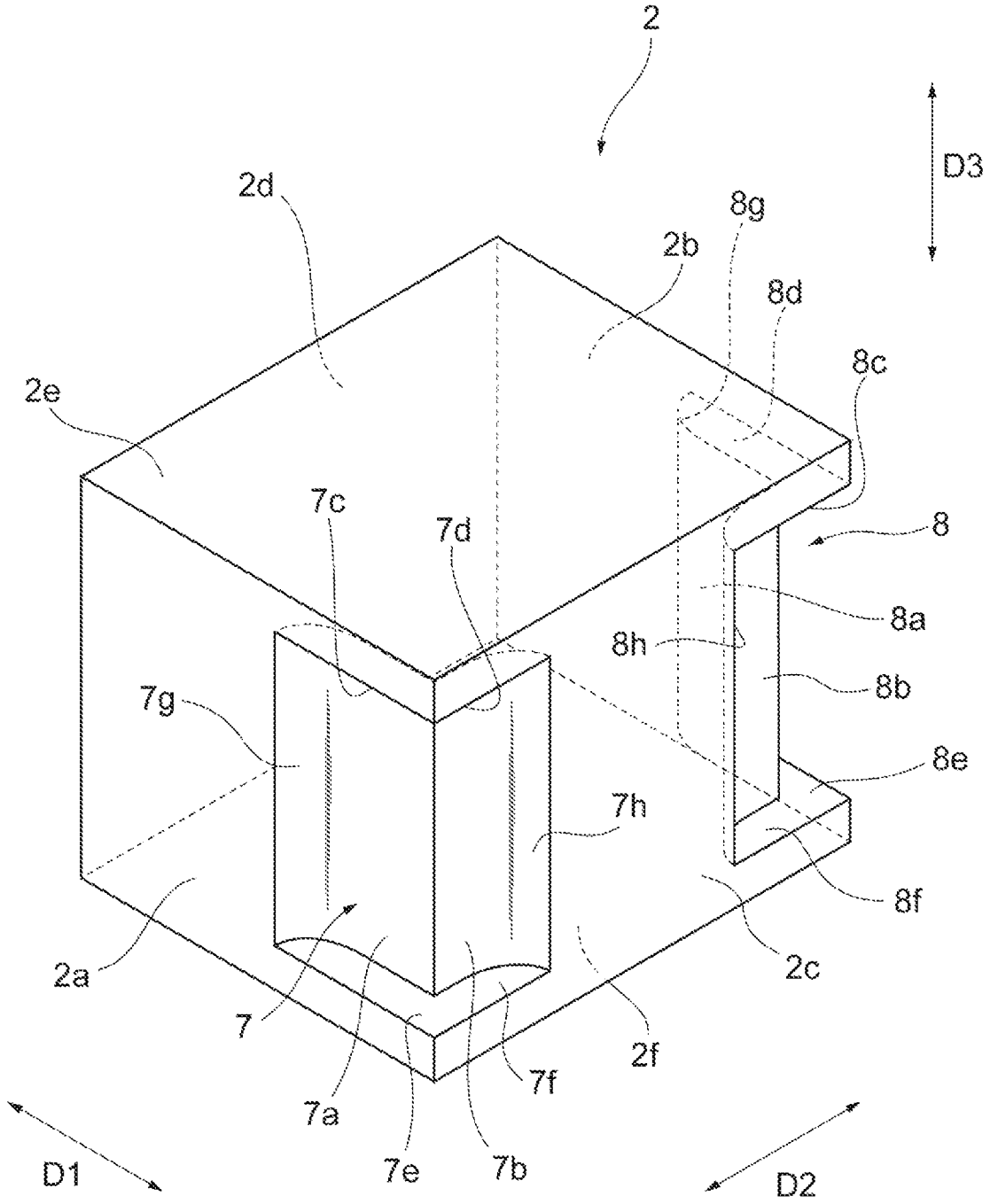
FIG. 3 is a perspective view of the element body.

As illustrated in FIG. 3, the element body 2 has recessed portions 7 and 8. The recessed portion 7 is provided on the end surface 2*a* side of the element body 2. The recessed portion 7 is a space recessed inward from the outer surface of the element body 2. The recessed portion 7 has a shape corresponding to the shape of the terminal electrode 4. In the present embodiment, the recessed portion 7 has an L shape when viewed from the third direction D3. The recessed portion 7 is defined by bottom surfaces 7*a* and 7*b* and side surfaces 7*c*, 7*d*, 7*e*, 7*f*, 7*g*, and 7*h*. The bottom surface 7*a* extends along the first direction D1 and the third direction D3. The bottom surface 7*a* is parallel to the end surfaces 2*a* and 2*b*. The bottom surface 7*b* extends along the second direction D2 and the third direction D3. The bottom surface 7*b* is parallel to the main surfaces 2*c* and 2*d*.

The side surface 7*c* and the side surface 7*e* are disposed so as to face each other in the third direction D3. The side surface 7*c* and the side surface 7*e* extend in the depth direction of the recessed portion 7 over the end surface 2*a* of the element body 2 and the bottom surface 7*a*. The side surface 7*c* and the side surface 7*e* extend along the first direction D1. The side surface 7*c* and the side surface 7*e* also extend in the second direction D2 (depth direction). The side surface 7*c* and the side surface 7*e* are parallel to the side surfaces 2*e* and 2*f*. The side surface 7*d* and the side surface 7*f* are disposed so as to face each other in the third direction D3. The side surface 7*d* and the side surface 7*f* extend over the main surface 2*c* of the element body 2 and the bottom surface 7*b*. The side surface 7*d* and the side surface 7*f* extend along the second direction D2. The side surface 7*d* and the side surface 7*f* also extend in the first direction D1 (depth direction). The side surface 7*d* and the side surface 7*f* are parallel to the side surfaces 2*e* and 2*f*. The side surface 7*g* is a curved surface. The side surface 7*g* extends over the end surface 2*a* of the element body 2 and the bottom surface 7*a*. The side surface 7*h* is a curved surface. The side surface 7*h* extends over the main surface 2*c* of the element body 2 and the bottom surface 7*b*.

The recessed portion 8 is provided on the end surface 2*b* side of the element body 2. The recessed portion 8 is a space recessed inward from the outer surface of the element body 2. The recessed portion 8 has a shape corresponding to the shape of the terminal electrode 5. In the present embodiment, the recessed portion 8 has an L shape when viewed from the third direction D3. The recessed portion 8 is defined by bottom surfaces 8*a* and 8*b* and side surfaces 8*c*, 8*d*, 8*e*, 8*f*, 8*g*, and 8*h*. The bottom surface 8*a* extends along the first direction D1 and the third direction D3. The bottom surface 8*a* is parallel to the end surfaces 2*a* and 2*b*. The bottom surface 8*b* extends along the second direction D2 and the third direction D3. The bottom surface 8*b* is parallel to the main surfaces 2*c* and 2*d*.

The side surface 8*c* and the side surface 8*e* are disposed so as to face each other in the third direction D3. The side surface 8*c* and the side surface 8*e* extend over the end surface 2*b* of the element body 2 and the bottom surface 8*a* (extend along the depth direction of the recessed portion 8). The side surface 8*c* and the side surface 8*e* extend along the first direction D1. The side surface 8*c* and the side surface 8*e* also extend in the second direction D2. The side surface 8*c* and the side surface 8*e* are parallel to the side surfaces 2*e* and 2*f*. The side surface 8*d* and the side surface 8*f* are disposed so as to face each other in the third direction D3. The side surface 8*d* and the side surface 8*f* extend over the main surface 2*c* of the element body 2 and the bottom surface 8*b*. The side surface 8*d* and the side surface 8*f* extend along the second direction D2. The side surface 8*d* and the side surface 8*f* also extend in the first direction D1. The side surface 8*d* and the side surface 8*f* are parallel to the side surfaces 2*e* and 2*f*. The side surface 8*g* is a curved surface. The side surface 8*g* extends over the end surface 2*b* of the element body 2 and the bottom surface 8*a*. The side surface 8*h* is a curved surface. The side surface 8*h* extends over the main surface 2*c* of the element body 2 and the bottom surface 8*b*.

Figure 4:
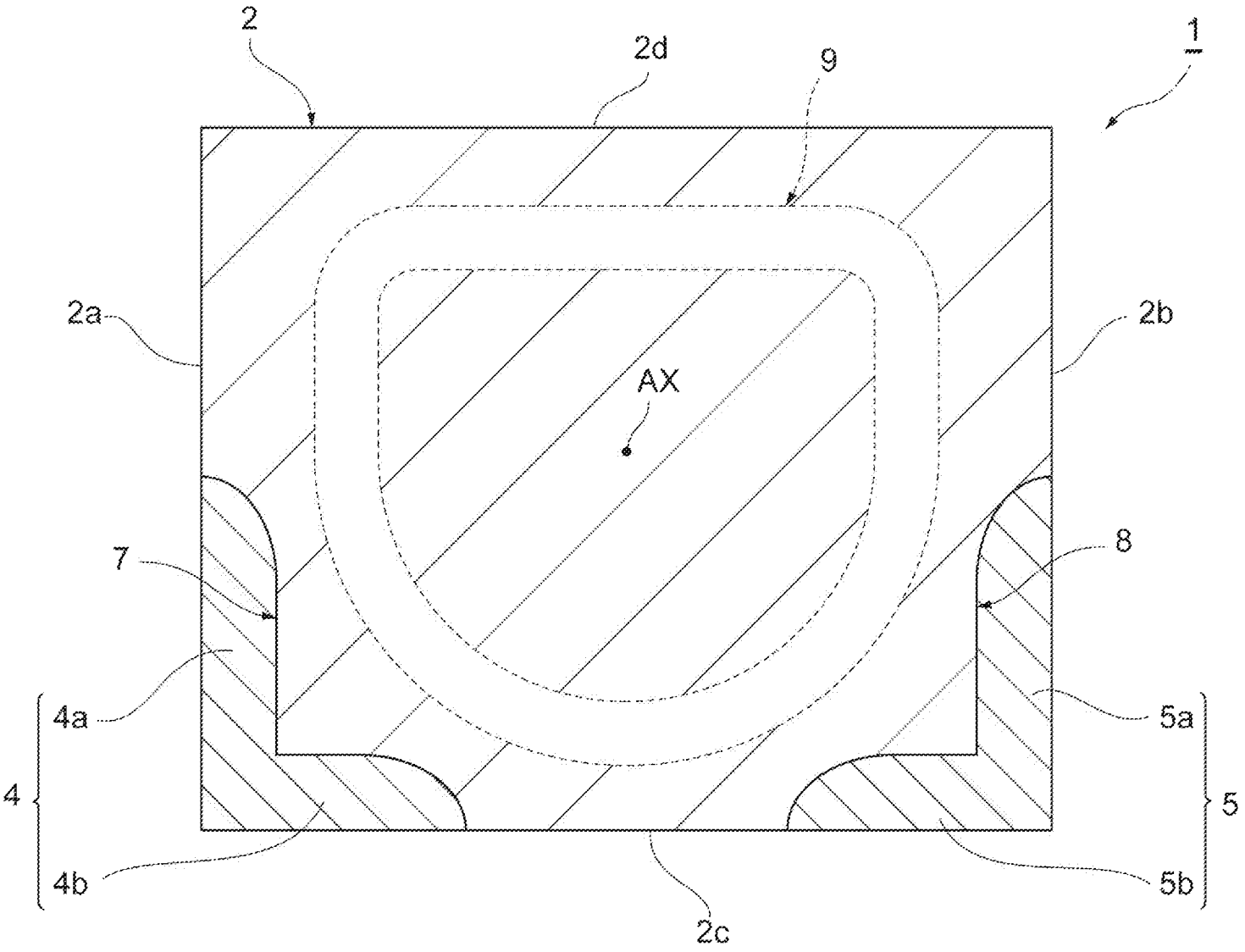
FIG. 4 is a cross-sectional view illustrating the configuration of the multilayer coil component.

As illustrated in FIG. 4, each of the terminal electrodes 4 and 5 is embedded in the element body 2. The terminal electrode 4 is disposed on the end surface 2*a* side of the element body 2. The terminal electrode 4 is disposed in the recessed portion 7 of the element body 2. The terminal electrode 4 is in contact with the bottom surfaces 7*a* and 7*b* and the side surfaces 7*c*, 7*d*, 7*e*, 7*f*, 7*g*, and 7*h* of the recessed portion 7. The terminal electrode 5 is disposed on the end surface 2*b* side of the element body 2. The terminal electrode 5 is disposed in the recessed portion 8 of the element body 2. The terminal electrode 5 is in contact with the bottom surfaces 8*a* and 8*b* and the side surfaces 8*c*, 8*d*, 8*e*, 8*f*, 8*g*, and 8*h*. The pair of terminal electrodes 4 and 5 are separated from each other in the second direction D2.

The terminal electrode 4 is disposed over the end surface 2*a* and the main surface 2*c*. The terminal electrode 5 is disposed over the end surface 2*b* and the main surface 2*c*. In the present embodiment, the surface of the terminal electrode 4 is substantially flush with each of the end surface 2*a* and the main surface 2*c*. The surface of the terminal electrode 5 is substantially flush with each of the end surface 2*b* and the main surface 2*c*.

The terminal electrode 4 has an L shape when viewed from the third direction D3. The terminal electrode 4 has a plurality of electrode parts 4*a* and 4*b*. In the present embodiment, the terminal electrode 4 has a pair of electrode parts 4*a* and 4*b*. The electrode part 4*a* and the electrode part 4*b* are interconnected in the ridge line portion of the element body 2 and are electrically connected to each other. In the present embodiment, the electrode part 4*a* and the electrode part 4*b* are integrally formed. The electrode part 4*a* extends along the first direction D1. The electrode part 4*a* has a rectangular shape when viewed from the second direction D2. The electrode part 4*b* extends along the second direction D2. The electrode part 4*b* has a rectangular shape when viewed from the first direction D1. Each of the electrode parts 4*a* and 4*b* extends along the third direction D3.

Figure 5B:
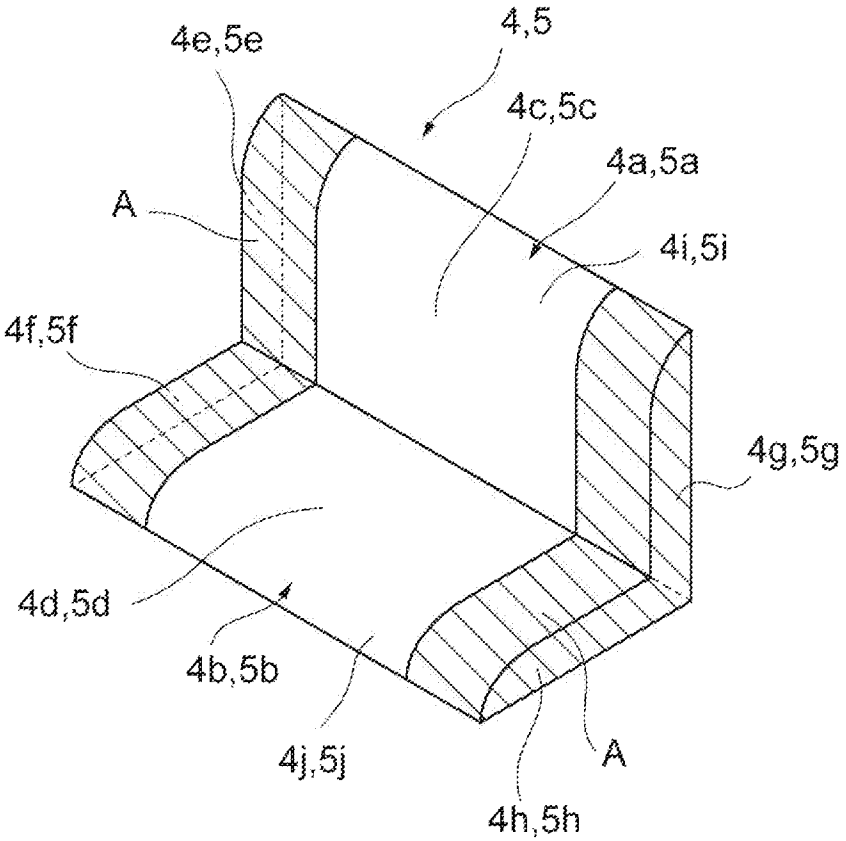
FIG. 5B is a perspective view of the terminal electrode.
Figure 5A:
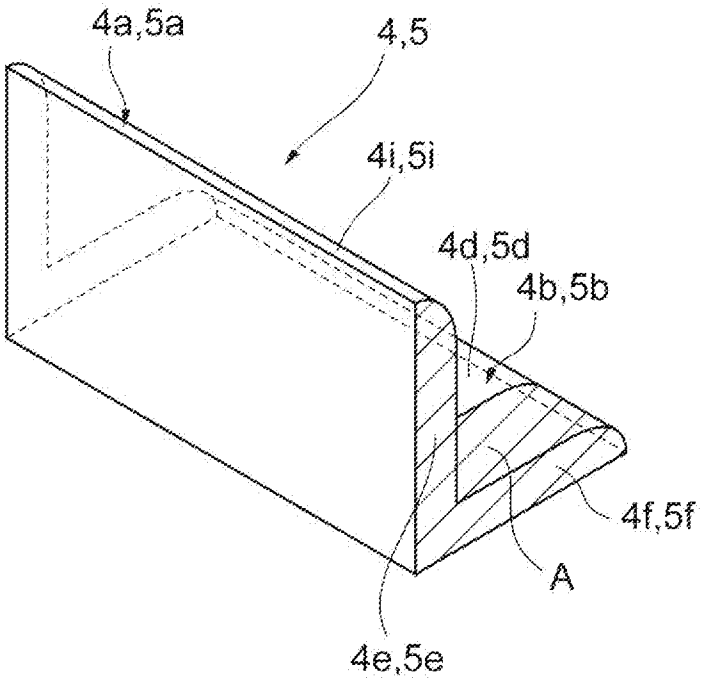
FIG. 5A is a perspective view of a terminal electrode.

As illustrated in FIGS. 5A and 5B, the terminal electrode 4 has first surfaces 4*c* and 4*d* and second surfaces 4*e*, 4*f*, 4*g*, 4*h*, 4*i*, and 4*j*. The first surface 4*c* is a surface facing (coming into contact with) the bottom surface 7*a* of the recessed portion 7 of the element body 2. The first surface 4*d* is a surface facing the bottom surface 7*b* of the recessed portion 7 of the element body 2. The second surface 4*e* is a surface facing the side surface 7*c* of the recessed portion 7 of the element body 2. The second surface 4*f* is a surface facing the side surface 7*d* of the recessed portion 7 of the element body 2. The second surface 4*g* is a surface facing the side surface 7*e* of the recessed portion 7 of the element body 2. The second surface 4*h* is a surface facing the side surface 7*f* of the recessed portion 7 of the element body 2. The second surface 4*i* is a surface facing the side surface 7*g* of the recessed portion 7 of the element body 2. The second surface 4*j* is a surface facing the side surface 7*h* of the recessed portion 7 of the element body 2.

As illustrated in FIG. 2, the terminal electrode 4 is configured by a plurality of electrode layers 10 and a plurality of electrode layers 11 being stacked. In the present embodiment, the number of the electrode layers 10 is "2" and the number of the electrode layers 11 is "4". The electrode layer 10 is disposed at a position sandwiching the electrode layer 11 in the third direction D3.

Each electrode layer 10 is provided in a defect portion formed in the insulator layer 6 that corresponds. The defect portion constitutes the recessed portion 7. The electrode layer 10 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. The content of the glass component may be appropriately set. Each electrode layer 10 has an L shape when viewed from the third direction D3. The electrode layer 10 has layer parts 10*a* and 10*b*. The layer part 10*a* extends along the first direction D1. The layer part 10*b* extends along the second direction D2.

Each electrode layer 11 is provided in a defect portion formed in the insulator layer 6 that corresponds. The defect portion constitutes the recessed portion 7. The electrode layer 11 is formed by conductive paste being fired. The conductive paste contains a conductive material. The conductive material is, for example, Ag or Pd. Each electrode layer 11 has an L shape when viewed from the third direction D3. The electrode layer 11 has layer parts 11*a* and 11*b*. The layer part 11*a* extends along the first direction D1. The layer part 11*b* extends along the second direction D2.

The electrode part 4*a* is configured by the respective layer parts 10*a* and 11*a* of the electrode layers 10 and 11 being stacked. At the electrode part 4*a*, the layer parts 10*a* and 11*a* are integrated to the extent that the boundary between the layer parts 10*a* and 11*a* is invisible. The electrode part 4*b* is configured by the respective layer parts 10*b* and 11*b* of the electrode layers 10 and 11 being stacked. At the electrode part 4*b*, the layer parts 10*b* and 11*b* are integrated to the extent that the boundary between the layer parts 10*b* and 11*b* is invisible.

As illustrated in FIGS. 5A and 5B, the terminal electrode 4 has a connection region A. The connection region A is a region exposed to the surface of the terminal electrode 4 that faces (comes into contact with) the recessed portion 7 of the element body 2. In the terminal electrode 4, the connection region A is provided on at least the second surfaces 4*e*, 4*f*, 4*g*, 4*h*, 4*i*, and 4*j* facing the side surfaces 7*c*, 7*d*, 7*e*, 7*f*, 7*g*, and 7*h*. In the present embodiment, the connection region A is provided on the first surfaces 4*c* and 4*d* facing the bottom surfaces 7*a* and 7*b* of the recessed portion 7 and the second surfaces 4*e*, 4*f*, 4*g*, 4*h*, 4*i*, and 4*j* facing the side surfaces 7*c*, 7*d*, 7*e*, 7*f*, 7*g*, and 7*h*. The connection region A is a region where a compound of elements constituting the element body 2 and a metal component are mixed. In other words, the connection region A contains a glass component. In the present embodiment, the electrode layer 10 constitutes the connection region A. The connection region A is provided on the second surfaces 4*e*, 4*f*, 4*g*, 4*h*, 4*i*, and 4*j* positioned in both end portions of the terminal electrode 4 in the third direction D3.

As illustrated in FIG. 4, the terminal electrode 5 has an L shape when viewed from the third direction D3. The terminal electrode 5 has a plurality of electrode parts 5*a* and 5*b*. In the present embodiment, the terminal electrode 5 has a pair of electrode parts 5*a* and 5*b*. The electrode part 5*a* and the electrode part 5*b* are interconnected in the ridge line portion of the element body 2 and are electrically connected to each other. In the present embodiment, the electrode part 5*a* and the electrode part 5*b* are integrally formed. The electrode part 5*a* extends along the first direction D1. The electrode part 5*a* has a rectangular shape when viewed from the second direction D2. The electrode part 5*b* extends along the second direction D2. The electrode part 5*b* has a rectangular shape when viewed from the first direction D1. Each of the electrode parts 5*a* and 5*b* extends along the third direction D3.

As illustrated in FIGS. 5A and 5B, the terminal electrode 5 has first surfaces 5*c* and 5*d* and second surfaces 5*e*, 5*f*, 5*g*, 5*h*, 5*i*, and 5*j*. The first surface 5*c* is a surface facing (coming into contact with) the bottom surface 8*a* of the recessed portion 8 of the element body 2. The first surface 5*d* is a surface facing the bottom surface 8*b* of the recessed portion 8 of the element body 2. The second surface 5*e* is a surface facing the side surface 8*c* of the recessed portion 8 of the element body 2. The second surface 5*f* is a surface facing the side surface 8*d* of the recessed portion 8 of the element body 2. The second surface 5*g* is a surface facing the side surface 8*e* of the recessed portion 8 of the element body 2. The second surface 5*h* is a surface facing the side surface 8*f* of the recessed portion 8 of the element body 2. The second surface 5*i* is a surface facing the side surface 8*g* of the recessed portion 8 of the element body 2. The second surface 5*j* is a surface facing the side surface 8*h* of the recessed portion 8 of the element body 2.

As illustrated in FIG. 2, the terminal electrode 5 is configured by a plurality of electrode layers 12 and a plurality of electrode layers 13 being stacked. In the present embodiment, the number of the electrode layers 12 is "2" and the number of the electrode layers 13 is "4". The electrode layer 12 is disposed at a position sandwiching the electrode layer 13 in the third direction D3.

Each electrode layer 12 is provided in a defect portion formed in the insulator layer 6 that corresponds. The defect portion constitutes the recessed portion 8. The electrode layer 12 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. Each electrode layer 12 has an L shape when viewed from the third direction D3. The electrode layer 12 has layer parts 12*a* and 12*b*. The layer part 12*a* extends along the first direction D1. The layer part 12*b* extends along the second direction D2.

Each electrode layer 13 is provided in a defect portion formed in the insulator layer 6 that corresponds. The defect portion constitutes the recessed portion 8. The electrode layer 13 is formed by conductive paste being fired. The conductive paste contains a conductive material. The conductive material is, for example, Ag or Pd. Each electrode layer 13 has an L shape when viewed from the third direction D3. The electrode layer 13 has layer parts 13*a* and 13*b*. The layer part 13*a* extends along the first direction D1. The layer part 13*b* extends along the second direction D2.

The electrode part 5*a* is configured by the respective layer parts 12*a* and 13*a* of the electrode layers 12 and 13 being stacked. At the electrode part 5*a*, the layer parts 12*a* and 13*a* are integrated to the extent that the boundary between the layer parts 12*a* and 13*a* is invisible. The electrode part 5*b* is configured by the respective layer parts 12*b* and 13*b* of the electrode layers 12 and 13 being stacked. At the electrode part 5*b*, the layer parts 12*b* and 13*b* are integrated to the extent that the boundary between the layer parts 12*b* and 13*b* is invisible.

As illustrated in FIGS. 5A and 5B, the terminal electrode 5 has a connection region A. The connection region A is a region exposed to the surface of the terminal electrode 5 that faces (comes into contact with) the recessed portion 8 of the element body 2. In the terminal electrode 5, the connection region A is provided on at least the second surfaces 5*e*, 5*f*, 5*g*, 5*h*, 5*i*, and 5*j* facing the side surfaces 8*c*, 8*d*, 8*e*, 8*f*, 8*g*, and 8*h*. In the present embodiment, the connection region A is provided on the first surfaces 5*c* and 5*d* facing the bottom surfaces 8*a* and 8*b* of the recessed portion 8 and the second surfaces 5*e*, 5*f*, 5*g*, 5*h*, 5*i*, and 5*j* facing the side surfaces 8*c*, 8*d*, 8*e*, 8*f*, 8*g*, and 8*h*. In the present embodiment, the electrode layer 12 constitutes the connection region A. The connection region A is provided on the second surfaces 5*e*, 5*f*, 5*g*, 5*h*, 5*i*, and 5*j* positioned in both end portions of the terminal electrode 5 in the third direction D3.

As illustrated in FIG. 4, the multilayer coil component 1 is provided with a coil 9 disposed in the element body 2. A coil axis AX of the coil 9 extends along the third direction D3.

As illustrated in FIG. 3, the coil 9 has a first coil conductor 22, a second coil conductor 23, a third coil conductor 24, and a fourth coil conductor 25. The first coil conductor 22, the second coil conductor 23, the third coil conductor 24, and the fourth coil conductor 25 are disposed along the third direction D3 in the order of the first coil conductor 22, the second coil conductor 23, the third coil conductor 24, and the fourth coil conductor 25. The first coil conductor 22, the second coil conductor 23, the third coil conductor 24, and the fourth coil conductor 25 substantially have a shape in which a part of a loop is interrupted and have one end and the other end. The first coil conductor 22, the second coil conductor 23, the third coil conductor 24, and the fourth coil conductor 25 are formed with a predetermined width.

The first coil conductor 22 is positioned in the same layer as one electrode layer 12 and one electrode layer 13. The first coil conductor 22 is connected to the electrode layer 13 via a connecting conductor 26. The connecting conductor 26 is positioned in the same layer as the first coil conductor 22. One end of the first coil conductor 22 is connected to the connecting conductor 26. The connecting conductor 26 is connected to the layer part 13*a*. The connecting conductor 26 interconnects the first coil conductor 22 and the electrode layer 13. The connecting conductor 26 may be connected to the layer part 13*b*. The first coil conductor 22 is separated from the electrode layer 11 positioned in the same layer. In the present embodiment, the first coil conductor 22, the connecting conductor 26, and the electrode layer 13 are integrally formed.

The second coil conductor 23 is positioned in the same layer as one electrode layer 11 and one electrode layer 13. The second coil conductor 23 is separated from the electrode layers 11 and 13 positioned in the same layer. The first coil conductor 22 and the second coil conductor 23 are adjacent to each other in the third direction D3 in a state where the insulator layer 6 is interposed between the first coil conductor 22 and the second coil conductor 23. The other end of the first coil conductor 22 and one end of the second coil conductor 23 overlap each other when viewed from the third direction D3.

The third coil conductor 24 is positioned in the same layer as one electrode layer 11 and one electrode layer 13. The third coil conductor 24 is separated from the electrode layers 11 and 13 positioned in the same layer. The second coil conductor 23 and the third coil conductor 24 are adjacent to each other in the third direction D3 in a state where the insulator layer 6 is interposed between the second coil conductor 23 and the third coil conductor 24. The other end of the second coil conductor 23 and one end of the third coil conductor 24 overlap each other when viewed from the third direction D3.

The fourth coil conductor 25 is positioned in the same layer as one electrode layer 12 and one electrode layer 13. The fourth coil conductor 25 is connected to the electrode layer 11 via a connecting conductor 27. The connecting conductor 27 is positioned in the same layer as the fourth coil conductor 25. The other end of the fourth coil conductor 25 is connected to the connecting conductor 27. The connecting conductor 27 is connected to the layer part 11*a*. The connecting conductor 27 interconnects the fourth coil conductor 25 and the electrode layer 11. The connecting conductor 27 may be connected to the layer part 11*b*. The fourth coil conductor 25 is separated from the electrode layer 13 positioned in the same layer. In the present embodiment, the fourth coil conductor 25, the connecting conductor 27, and the electrode layer 11 are integrally formed.

The third coil conductor 24 and the fourth coil conductor 25 are adjacent to each other in the third direction D3 in a state where the insulator layer 6 is interposed between the third coil conductor 24 and the fourth coil conductor 25. The other end of the third coil conductor 24 and one end of the fourth coil conductor 25 overlap each other when viewed from the third direction D3.

The first coil conductor 22, the second coil conductor 23, the third coil conductor 24, and the fourth coil conductor 25 are electrically interconnected. The first coil conductor 22, the second coil conductor 23, the third coil conductor 24, and the fourth coil conductor 25 constitute the coil 9. The coil 9 is electrically connected to the terminal electrode 5 through the connecting conductor 26. The coil 9 is electrically connected to the terminal electrode 4 through the connecting conductor 27.

The first coil conductor 22, the second coil conductor 23, the third coil conductor 24, the fourth coil conductor 25, and the connecting conductors 26 and 27 contain a conductive material. The conductive material contains Ag or Pd. The first coil conductor 22, the second coil conductor 23, the third coil conductor 24, the fourth coil conductor 25, and the connecting conductors 26 and 27 are configured as a sintered body of conductive paste containing conductive material powder. Examples of the conductive material powder include Ag powder and Pd powder.

In the present embodiment, the first coil conductor 22, the second coil conductor 23, the third coil conductor 24, the fourth coil conductor 25, and the connecting conductors 26 and 27 contain the same conductive material as each of the terminal electrodes 4 and 5. The first coil conductor 22, the second coil conductor 23, the third coil conductor 24, the fourth coil conductor 25, and the connecting conductors 26 and 27 may contain a conductive material different from the conductive material of each of the terminal electrodes 4 and 5.

The first coil conductor 22, the second coil conductor 23, the third coil conductor 24, the fourth coil conductor 25, and the connecting conductors 26 and 27 are provided in a defect portion formed in the insulator layer 6 that corresponds. The first coil conductor 22, the second coil conductor 23, the third coil conductor 24, the fourth coil conductor 25, and the connecting conductors 26 and 27 are formed by conductive paste positioned in a defect portion formed in a green sheet being fired.

The defect portion formed in the green sheet is formed by, for example, the following process. First, a green sheet is formed by element paste containing the constituent material of the insulator layer 6 and a photosensitive material being applied onto a base material. The base material is, for example, a PET film. The photosensitive material contained in the element paste may be either a negative photosensitive material or a positive photosensitive material and a known photosensitive material can be used. Next, the green sheet is exposed and developed by a photolithography method by means of a mask corresponding to the defect portion, and then the defect portion is formed in the green sheet on the base material. The green sheet in which the defect portion is formed is an element pattern.

The electrode layers 10, 11, 12, and 13, the first coil conductor 22, the second coil conductor 23, the third coil conductor 24, the fourth coil conductor 25, and the connecting conductors 26 and 27 are formed by, for example, the following process.

First, a conductive material layer is formed by conductive paste containing a photosensitive material being applied onto a base material. The photosensitive material contained in the conductive paste may be either a negative photosensitive material or a positive photosensitive material and a known photosensitive material can be used. Next, the conductive material layer is exposed and developed by a photolithography method by means of a mask corresponding to the defect portion, and then a conductor pattern corresponding to the shape of the defect portion is formed on the base material.

The multilayer coil component 1 is obtained by, for example, the following process subsequent to the process described above. A sheet in which the element pattern and the conductor pattern are in the same layer is prepared by the conductor pattern being combined with the defect portion of the element pattern. A predetermined number of the sheets are prepared, a stacked body is obtained by the sheets being stacked, heat treatment is performed on the stacked body, and then a plurality of green chips are obtained from the stacked body. In this process, a green stacked body is cut into chips by means of a cutting machine or the like. As a result, a plurality of green chips having a predetermined size can be obtained. Next, the green chips are fired. The multilayer coil component 1 is obtained as a result of the firing. A plating layer may be formed on the surface of each of the terminal electrodes 4 and 5. The plating layer is formed by, for example, electroplating or electroless plating. The plating layer contains, for example, Ni, Sn, or Au.

As described above, in the multilayer coil component 1 according to the present embodiment, the connection region A where a compound of elements constituting the element body 2 and a metal component are mixed is exposed on the second surfaces 4*e*, 4*f*, 4*g*, 4*h*, 4*i*, and 4*j* of the terminal electrode 4. In addition, the connection region A where a compound of elements constituting the element body 2 and a metal component are mixed is exposed on the second surfaces 5*e*, 5*f*, 5*g*, 5*h*, 5*i*, and 5*j* of the terminal electrode 5. In this manner, in the multilayer coil component 1, the surface of the terminal electrode 4 that comes into contact with the side surfaces 7*c*, 7*d*, 7*e*, 7*f*, 7*g*, and 7*h* of the recessed portion 7 of the element body 2 and the surface of the terminal electrode 5 that comes into contact with the side surfaces 8*c*, 8*d*, 8*e*, 8*f*, 8*g*, and 8*h* of the recessed portion 8 of the element body 2 contain a compound of elements constituting the element body 2, and thus the adhesion strength between the connection region A and the element body 2 is improved. Accordingly, in the multilayer coil component 1, the adhesion strength between the element body 2 and the second surfaces 4*e*, 4*f*, 4*g*, 4*h*, 4*i*, and 4*j* of the terminal electrode 4 and the second surfaces 5*e*, 5*f*, 5*g*, 5*h*, 5*i*, and 5*j* of the terminal electrode 5 is improved. Accordingly, in the multilayer coil component 1, it is possible to suppress the occurrence of peeling at the adhesion part between the side surfaces 7*c*, 7*d*, 7*e*, 7*f*, 7*g*, and 7*h* of the recessed portion 7 of the element body 2 and the terminal electrode 4 and the adhesion part between the side surfaces 8*c*, 8*d*, 8*e*, 8*f*, 8*g*, and 8*h* of the recessed portion 8 and the terminal electrode 5. As a result, peeling of the terminal electrodes 4 and 5 can be suppressed in the multilayer coil component 1.

In the multilayer coil component 1 according to the present embodiment, the connection region A is exposed to the second surfaces 4*e*, 4*f*, 4*g*, and 4*h* positioned in both end portions of the terminal electrode 4 in the direction in which the plurality of insulator layers 6 are stacked. In this configuration, the adhesion strength between the second surfaces 4*e*, 4*f*, 4*g*, and 4*h* positioned in both end portions of the terminal electrode 4 and the element body 2 is improved. In addition, the connection region A is exposed to the second surfaces 5*e*, 5*f*, 5*g*, and 5*h* positioned in both end portions of the terminal electrode 5 in the direction in which the plurality of insulator layers 6 are stacked. In this configuration, the adhesion strength between the second surfaces 5*e*, 5*f*, 5*g*, and 5*h* positioned in both end portions of the terminal electrode 5 and the element body 2 is improved. Accordingly, peeling of the terminal electrodes 4 and 5 can be further suppressed in the multilayer coil component 1.

In the multilayer coil component 1 according to the present embodiment, the connection region A is exposed to the first surfaces 4*c* and 4*d* of the terminal electrode 4. In this configuration, the adhesion strength between the element body 2 and the first surfaces 4*c* and 4*d* of the terminal electrode 4 as well as the adhesion between the element body 2 and the second surfaces 4*e*, 4*f*, 4*g*, and 4*h* is improved. In addition, the connection region A is exposed to the first surfaces 5*c* and 5*d* of the terminal electrode 5. In this configuration, the adhesion strength between the element body 2 and the first surfaces 5*c* and 5*d* of the terminal electrode 5 as well as the adhesion between the element body 2 and the second surfaces 5*e*, 5*f*, 5*g*, and 5*h* is improved. Accordingly, peeling of the terminal electrodes 4 and 5 can be further suppressed in the multilayer coil component 1.

Second Embodiment

Figure 6:
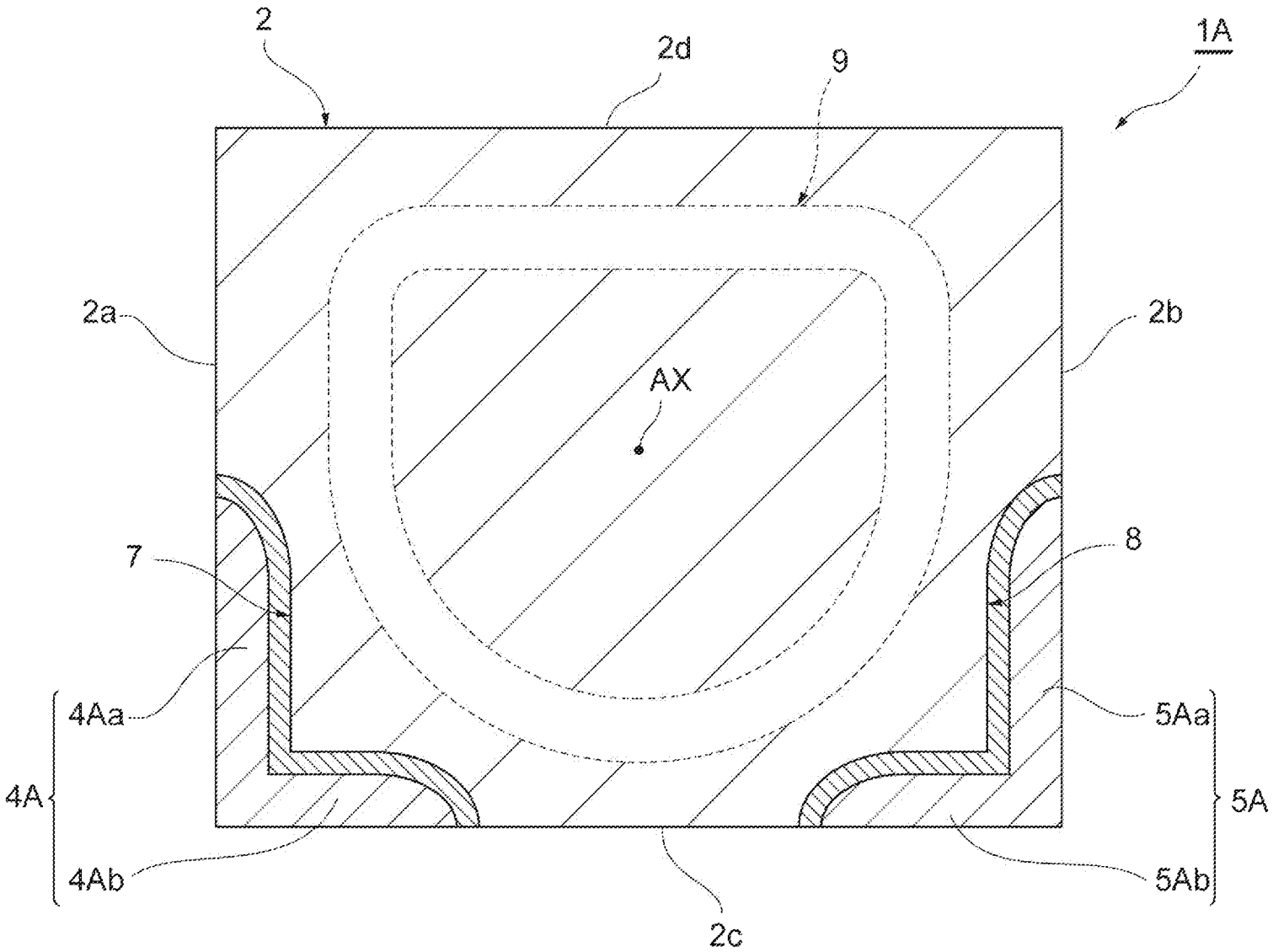
FIG. 6 is a cross-sectional view illustrating the configuration of a multilayer coil component according to a second embodiment.

Subsequently, a second embodiment will be described. As illustrated in FIG. 6, a multilayer coil component 1A is provided with the element body 2 having a rectangular parallelepiped shape and a pair of terminal electrodes 4A and 5A.

The terminal electrode 4A has an L shape when viewed from the third direction D3. The terminal electrode 4A has a plurality of electrode parts 4Aa and 4Ab. In the present embodiment, the terminal electrode 4A has a pair of electrode parts 4Aa and 4Ab. The electrode part 4Aa and the electrode part 4Ab are interconnected in the ridge line portion of the element body 2 and are electrically connected to each other. In the present embodiment, the electrode part 4Aa and the electrode part 4Ab are integrally formed. The electrode part 4Aa extends along the first direction D1. The electrode part 4Aa has a rectangular shape when viewed from the second direction D2. The electrode part 4Ab extends along the second direction D2. The electrode part 4Ab has a rectangular shape when viewed from the first direction D1. Each of the electrode parts 4Aa and 4Ab extends along the third direction D3.

Figure 7B:
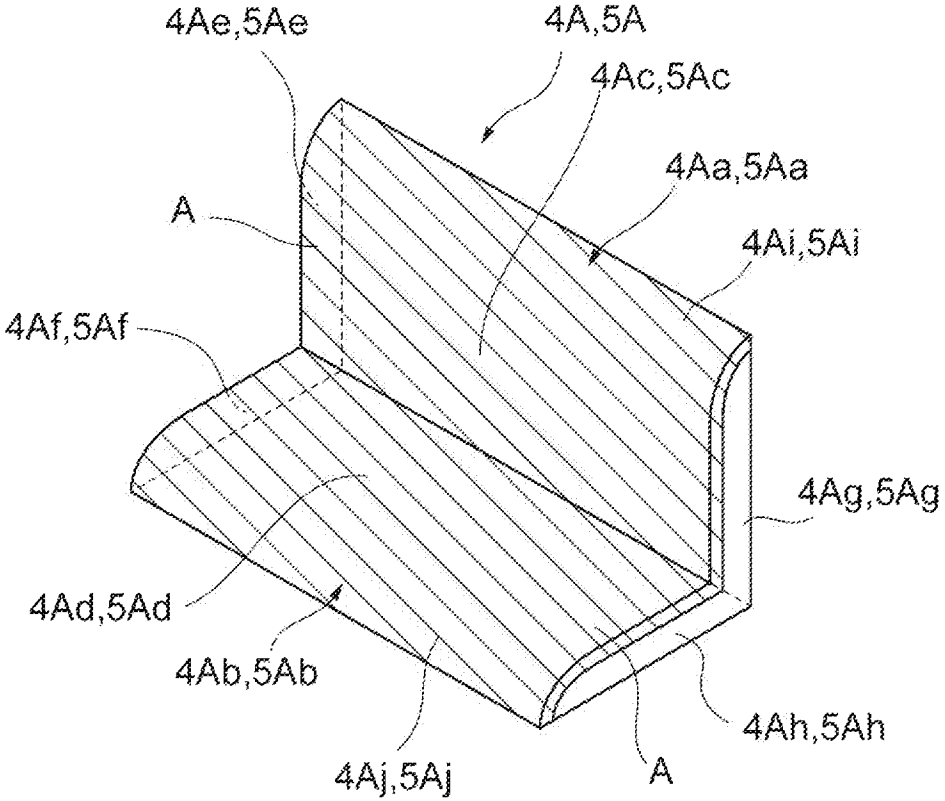
FIG. 7B is a perspective view of the terminal electrode.
Figure 7A:
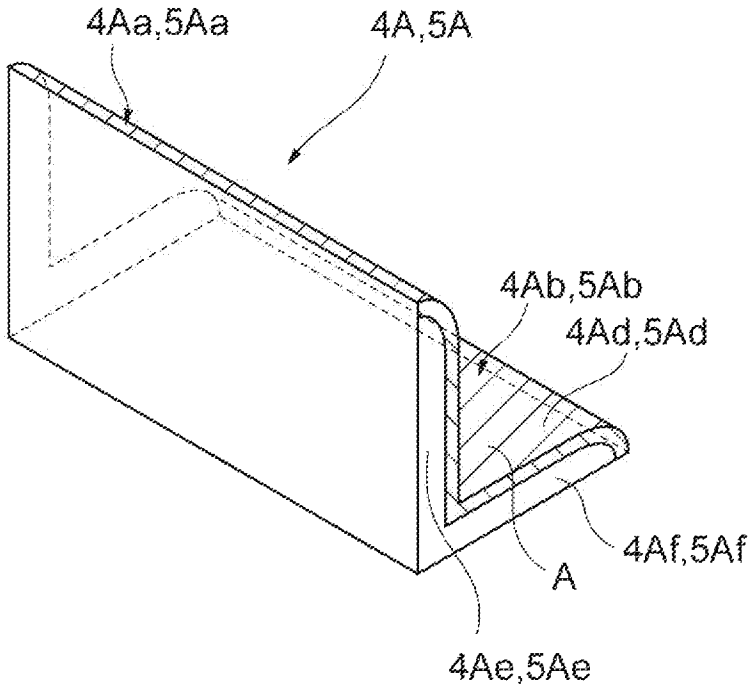
FIG. 7A is a perspective view of a terminal electrode.

As illustrated in FIGS. 7A and 7B, the terminal electrode 4A has first surfaces 4Ac and 4Ad and second surfaces 4Ae, 4Af, 4Ag, 4Ah, 4Ai, and 4Aj. The first surface 4Ac is a surface facing (coming into contact with) the bottom surface 7*a* of the recessed portion 7 of the element body 2. The first surface 4Ad is a surface facing the bottom surface 7*b* of the recessed portion 7 of the element body 2. The second surface 4Ae is a surface facing the side surface 7*c* of the recessed portion 7 of the element body 2. The second surface 4Af is a surface facing the side surface 7*d* of the recessed portion 7 of the element body 2. The second surface 4Ag is a surface facing the side surface 7*e* of the recessed portion 7 of the element body 2. The second surface 4Ah is a surface facing the side surface 7*f* of the recessed portion 7 of the element body 2. The second surface 4Ai is a surface facing the side surface 7*g* of the recessed portion 7 of the element body 2. The second surface 4Aj is a surface facing the side surface 7*h* of the recessed portion 7 of the element body 2.

Figure 8:
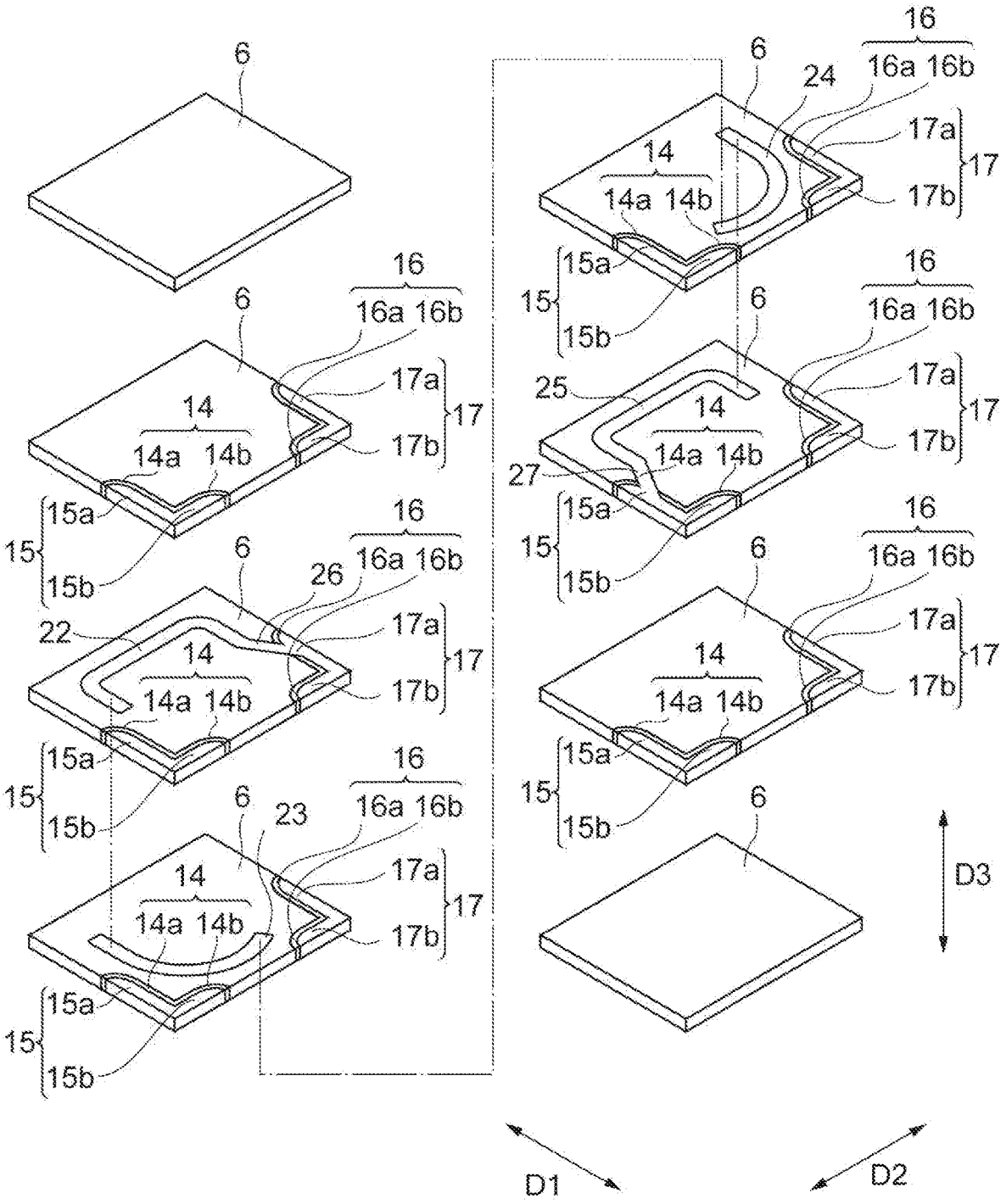
FIG. 8 is an exploded perspective view of the element body of the multilayer coil component of FIG. 6.

As illustrated in FIG. 8, the terminal electrode 4A is configured by a plurality of electrode layers 14 and a plurality of electrode layers 15 being stacked. In the present embodiment, the number of the electrode layers 14 is "6" and the number of the electrode layers 15 is "6".

Each electrode layer 14 is provided in a defect portion formed in the insulator layer 6 that corresponds. The defect portion constitutes the recessed portion 7. The electrode layer 15 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. Each electrode layer 14 has an L shape when viewed from the third direction D3. The electrode layer 14 has layer parts 14*a* and 14*b*. The layer part 14*a* extends along the first direction D1. The layer part 14*b* extends along the second direction D2.

Each electrode layer 15 is provided in a defect portion formed in the insulator layer 6 that corresponds. Each electrode layer 15 is positioned in the same insulator layer 6 as each electrode layer 14. The electrode layer 15 is provided in a region outside the electrode layer 14 in the defect portion of the insulator layer 6. The electrode layer 15 is formed by conductive paste being fired. The conductive paste contains a conductive material. The conductive material is, for example, Ag or Pd. Each electrode layer 15 has an L shape when viewed from the third direction D3. The electrode layer 15 has layer parts 15*a* and 15*b*. The layer part 15*a* extends along the first direction D1. The layer part 15*b* extends along the second direction D2.

The electrode part 4Aa is configured by the respective layer parts 14*a* and 15*a* of the electrode layers 14 and 15 being stacked. At the electrode part 4Aa, the layer parts 14*a* and 15*a* are integrated to the extent that the boundary between the layer parts 14*a* and 15*a* is invisible. The electrode part 4Ab is configured by the respective layer parts 14*b* and 15*b* of the electrode layers 14 and 15 being stacked. At the electrode part 4Ab, the layer parts 14*b* and 15*b* are integrated to the extent that the boundary between the layer parts 14*b* and 15*b* is invisible.

As illustrated in FIGS. 7A and 7B, the terminal electrode 4A has a connection region A. The connection region A is a region exposed to the surface of the terminal electrode 4A that faces (comes into contact with) the recessed portion 7 of the element body 2. In the terminal electrode 4A, the connection region A is provided on at least the second surfaces 4Ae, 4Af, 4Ag, 4Ah, 4Ai, and 4Aj facing the side surfaces 7*c*, 7*d*, 7*e*, 7*f*, 7*g*, and 7*h*. In the present embodiment, the connection region A is provided on the first surfaces 4Ac and 4Ad facing the bottom surfaces 7*a* and 7*b* of the recessed portion 7 and the second surfaces 4Ae, 4Af, 4Ag, 4Ah, 4Ai, and 4Aj facing the side surfaces 7*c*, 7*d*, 7*e*, 7*f*, 7*g*, and 7*h*. The connection region A is a region where a compound of elements constituting the element body 2 and a metal component are mixed. In other words, the connection region A contains a glass component. In the present embodiment, the electrode layer 14 constitutes the connection region A.

As illustrated in FIG. 6, the terminal electrode 5A has an L shape when viewed from the third direction D3. The terminal electrode 5A has a plurality of electrode parts 5Aa and 5Ab. In the present embodiment, the terminal electrode 5A has a pair of electrode parts 5Aa and 5Ab. The electrode part 5Aa and the electrode part 5Ab are interconnected in the ridge line portion of the element body 2 and are electrically connected to each other. In the present embodiment, the electrode part 5Aa and the electrode part 5Ab are integrally formed. The electrode part 5Aa extends along the first direction D1. The electrode part 5Aa has a rectangular shape when viewed from the second direction D2. The electrode part 5Ab extends along the second direction D2. The electrode part 5Ab has a rectangular shape when viewed from the first direction D1. Each of the electrode parts 5Aa and 5Ab extends along the third direction D3.

As illustrated in FIGS. 7A and 7B, the terminal electrode 5A has first surfaces 5Ac and 5Ad and second surfaces 5Ae, 5Af, 5Ag, 5Ah, 5Ai, and 5Aj. The first surface 5Ac is a surface facing (coming into contact with) the bottom surface 8*a* of the recessed portion 8 of the element body 2. The first surface 5Ad is a surface facing the bottom surface 8*b* of the recessed portion 8 of the element body 2. The second surface 5Ae is a surface facing the side surface 8*c* of the recessed portion 8 of the element body 2. The second surface 5Af is a surface facing the side surface 8*d* of the recessed portion 8 of the element body 2. The second surface 5Ag is a surface facing the side surface 8*e* of the recessed portion 8 of the element body 2. The second surface 5Ah is a surface facing the side surface 8*f* of the recessed portion 8 of the element body 2. The second surface 5Ai is a surface facing the side surface 8*g* of the recessed portion 8 of the element body 2. The second surface 5Aj is a surface facing the side surface 8*h* of the recessed portion 8 of the element body 2.

As illustrated in FIG. 8, the terminal electrode 5A is configured by a plurality of electrode layers 16 and a plurality of electrode layers 17 being stacked. In the present embodiment, the number of the electrode layers 16 is "6" and the number of the electrode layers 17 is "6".

Each electrode layer 16 is provided in a defect portion formed in the insulator layer 6 that corresponds. The defect portion constitutes the recessed portion 7. The electrode layer 16 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. Each electrode layer 16 has an L shape when viewed from the third direction D3. The electrode layer 16 has layer parts 16*a* and 16*b*. The layer part 16*a* extends along the first direction D1. The layer part 16*b* extends along the second direction D2.

Each electrode layer 17 is provided in a defect portion formed in the insulator layer 6 that corresponds. Each electrode layer 17 is positioned in the same insulator layer 6 as each electrode layer 16. The electrode layer 17 is provided in a region outside the electrode layer 16 in the defect portion of the insulator layer 6. The electrode layer 17 is formed by conductive paste being fired. The conductive paste contains a conductive material. The conductive material is, for example, Ag or Pd. Each electrode layer 17 has an L shape when viewed from the third direction D3. The electrode layer 17 has layer parts 17*a* and 17*b*. The layer part 17*a* extends along the first direction D1. The layer part 17*b* extends along the second direction D2.

The electrode part 5Aa is configured by the respective layer parts 16*a* and 17*a* of the electrode layers 16 and 17 being stacked. At the electrode part 5Aa, the layer parts 16*a* and 17*a* are integrated to the extent that the boundary between the layer parts 16*a* and 17*a* is invisible. The electrode part 5Ab is configured by the respective layer parts 16*b* and 17*b* of the electrode layers 16 and 17 being stacked. At the electrode part 5Ab, the layer parts 16*b* and 17*b* are integrated to the extent that the boundary between the layer parts 16*b* and 17*b* is invisible.

As illustrated in FIGS. 7A and 7B, the terminal electrode 5A has a connection region A. The connection region A is a region exposed to the surface of the terminal electrode 5A that faces (comes into contact with) the recessed portion 8 of the element body 2. In the terminal electrode 5A, the connection region A is provided on at least the second surfaces 5Ae, 5Af, 5Ag, 5Ah, 5Ai, and 5Aj facing the side surfaces 8*c*, 8*d*, 8*e*, 8*f*, 8*g*, and 8*h*. In the present embodiment, the connection region A is provided on the first surfaces 5Ac and 5Ad facing the bottom surfaces 8*a* and 8*b* of the recessed portion 8 and the second surfaces 5Ae, 5Af, 5Ag, 5Ah, 5Ai, and 5Aj facing the side surfaces 8*c*, 8*d*, 8*e*, 8*f*, 8*g*, and 8*h*. The connection region A is a region where a compound of elements constituting the element body 2 and a metal component are mixed. In other words, the connection region A contains a glass component. In the present embodiment, the electrode layer 16 constitutes the connection region A.

As described above, in the multilayer coil component 1A according to the present embodiment, the connection region A where a compound of elements constituting the element body 2 and a metal component are mixed is exposed on the second surfaces 4Ae, 4Af, 4Ag, 4Ah, 4Ai, and 4Aj of the terminal electrode 4A. In addition, the connection region A where a compound of elements constituting the element body 2 and a metal component are mixed is exposed on the second surfaces 5Ae, 5Af, 5Ag, 5Ah, 5Ai, and 5Aj of the terminal electrode 5A. In this manner, in the multilayer coil component 1A, the surface of the terminal electrode 4A that comes into contact with the side surfaces 7*c*, 7*d*, 7*e*, 7*f*, 7*g*, and 7*h* of the recessed portion 7 of the element body 2 and the surface of the terminal electrode 5A that comes into contact with the side surfaces 8*c*, 8*d*, 8*e*, 8*f*, 8*g*, and 8*h* of the recessed portion 8 of the element body 2 contain a compound of elements constituting the element body 2, and thus the adhesion strength between the connection region A and the element body 2 is improved. Accordingly, in the multilayer coil component 1A, the adhesion strength between the element body 2 and the second surfaces 4Ae, 4Af, 4Ag, 4Ah, 4Ai, and 4Aj of the terminal electrode 4A and the second surfaces 5Ae, 5Af, 5Ag, 5Ah, 5Ai, and 5Aj of the terminal electrode 5 is improved. Accordingly, in the multilayer coil component 1A, it is possible to suppress the occurrence of peeling at the adhesion part between the side surfaces 7*c*, 7*d*, 7*e*, 7*f*, 7*g*, and 7*h* of the recessed portion 7 of the element body 2 and the terminal electrode 4A and the adhesion part between the side surfaces 8*c*, 8*d*, 8*e*, 8*f*, 8*g*, and 8*h* of the recessed portion 8 and the terminal electrode 5A. As a result, peeling of the terminal electrodes 4A and 5A can be suppressed in the multilayer coil component 1A.

Third Embodiment

Figure 9:
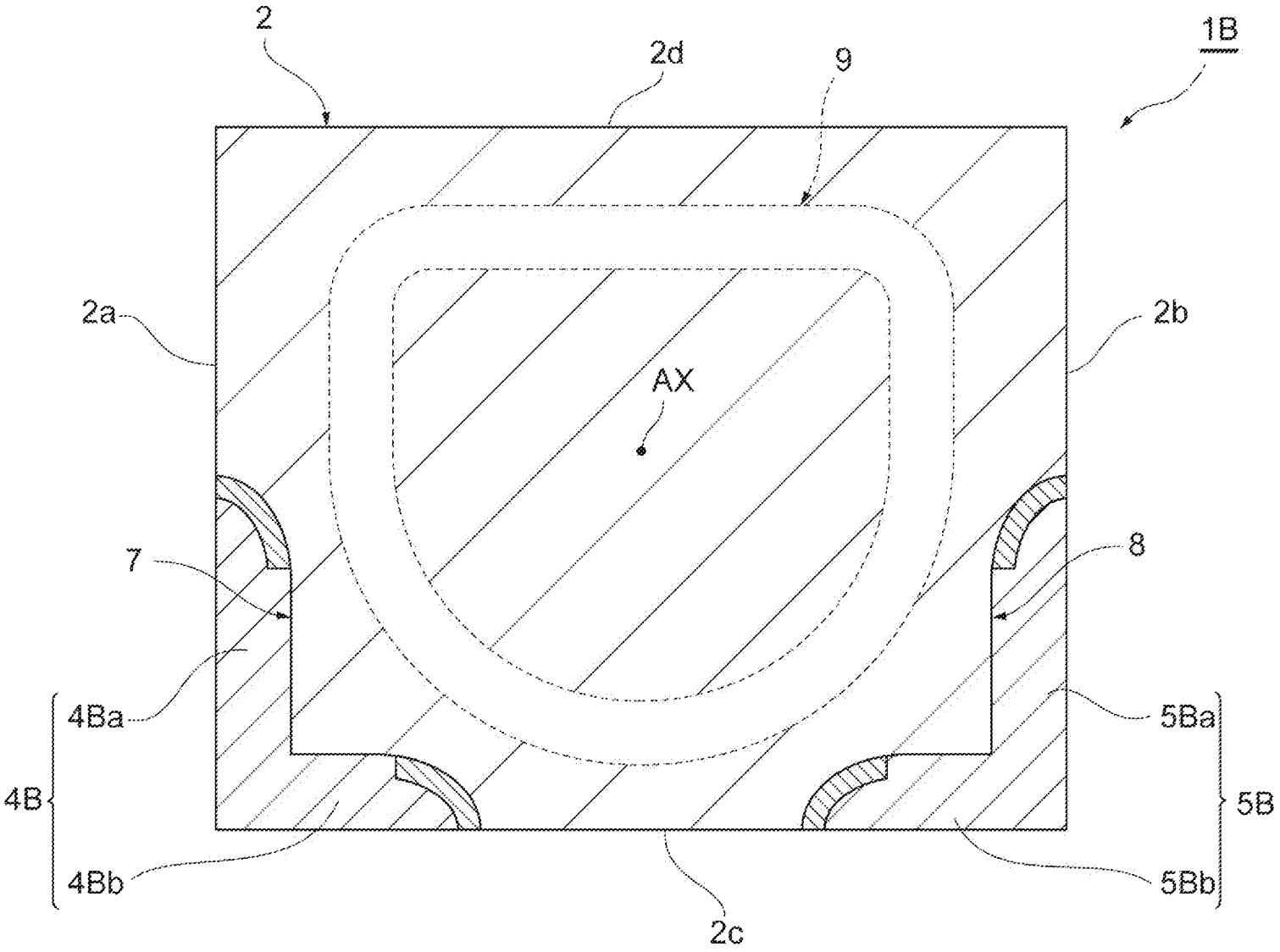
FIG. 9 is a cross-sectional view illustrating the configuration of a multilayer coil component according to a third embodiment.

Subsequently, a third embodiment will be described. As illustrated in FIG. 9, a multilayer coil component 1B is provided with the element body 2 having a rectangular parallelepiped shape and a pair of terminal electrodes 4B and 5B.

The terminal electrode 4B has an L shape when viewed from the third direction D3. The terminal electrode 4B has a plurality of electrode parts 4Ba and 4Bb. In the present embodiment, the terminal electrode 4B has a pair of electrode parts 4Ba and 4Bb. The electrode part 4Ba and the electrode part 4Bb are interconnected in the ridge line portion of the element body 2 and are electrically connected to each other. In the present embodiment, the electrode part 4Ba and the electrode part 4Bb are integrally formed. The electrode part 4Ba extends along the first direction D1. The electrode part 4Ba has a rectangular shape when viewed from the second direction D2. The electrode part 4Bb extends along the second direction D2. The electrode part 4Bb has a rectangular shape when viewed from the first direction D1. Each of the electrode parts 4Ba and 4Bb extends along the third direction D3.

Figure 10B:
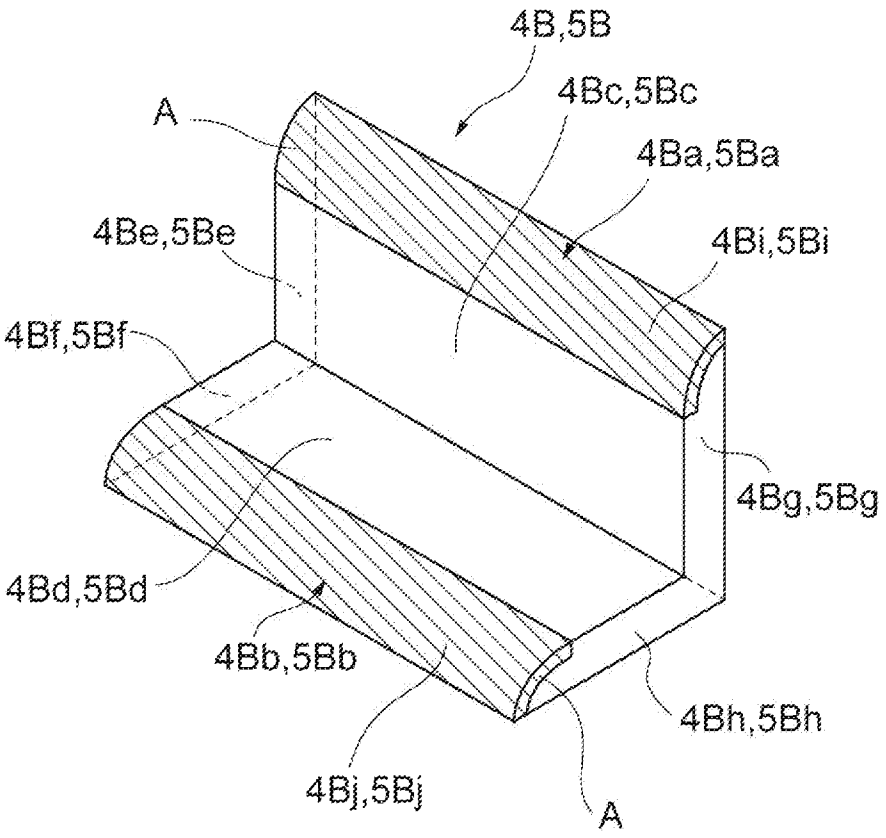
FIG. 10B is a perspective view of the terminal electrode.
Figure 10A:
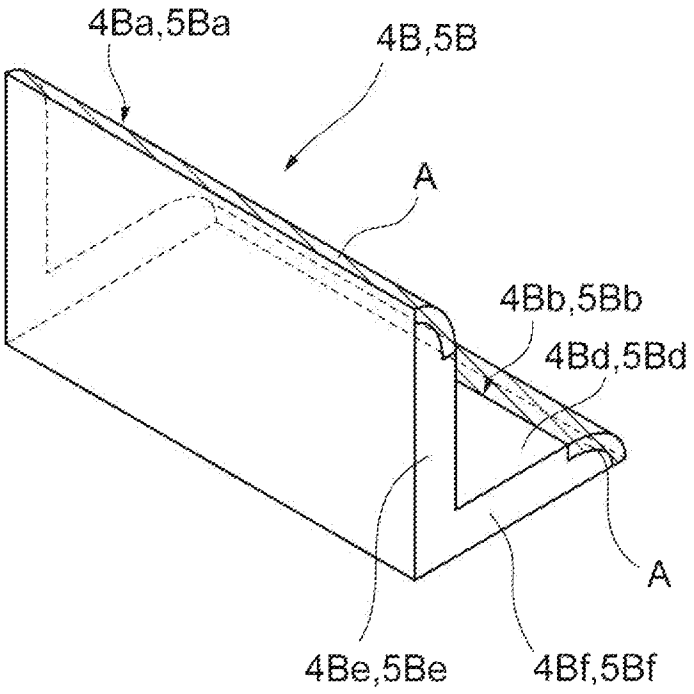
FIG. 10A is a perspective view of a terminal electrode.

As illustrated in FIGS. 10A and 10B, the terminal electrode 4B has first surfaces 4Bc and 4Bd and second surfaces 4Be, 4Bf, 4Bg, 4Bh, 4Bi, and 4Bj. The first surface 4Bc is a surface facing (coming into contact with) the bottom surface 7*a* of the recessed portion 7 of the element body 2. The first surface 4Bd is a surface facing the bottom surface 7*b* of the recessed portion 7 of the element body 2. The second surface 4Be is a surface facing the side surface 7*c* of the recessed portion 7 of the element body 2. The second surface 4Bf is a surface facing the side surface 7*d* of the recessed portion 7 of the element body 2. The second surface 4Bg is a surface facing the side surface 7*e* of the recessed portion 7 of the element body 2. The second surface 4Bh is a surface facing the side surface 7*f* of the recessed portion 7 of the element body 2. The second surface 4Bi is a surface facing the side surface 7*g* of the recessed portion 7 of the element body 2. The second surface 4Bj is a surface facing the side surface 7*h* of the recessed portion 7 of the element body 2.

Figure 11:
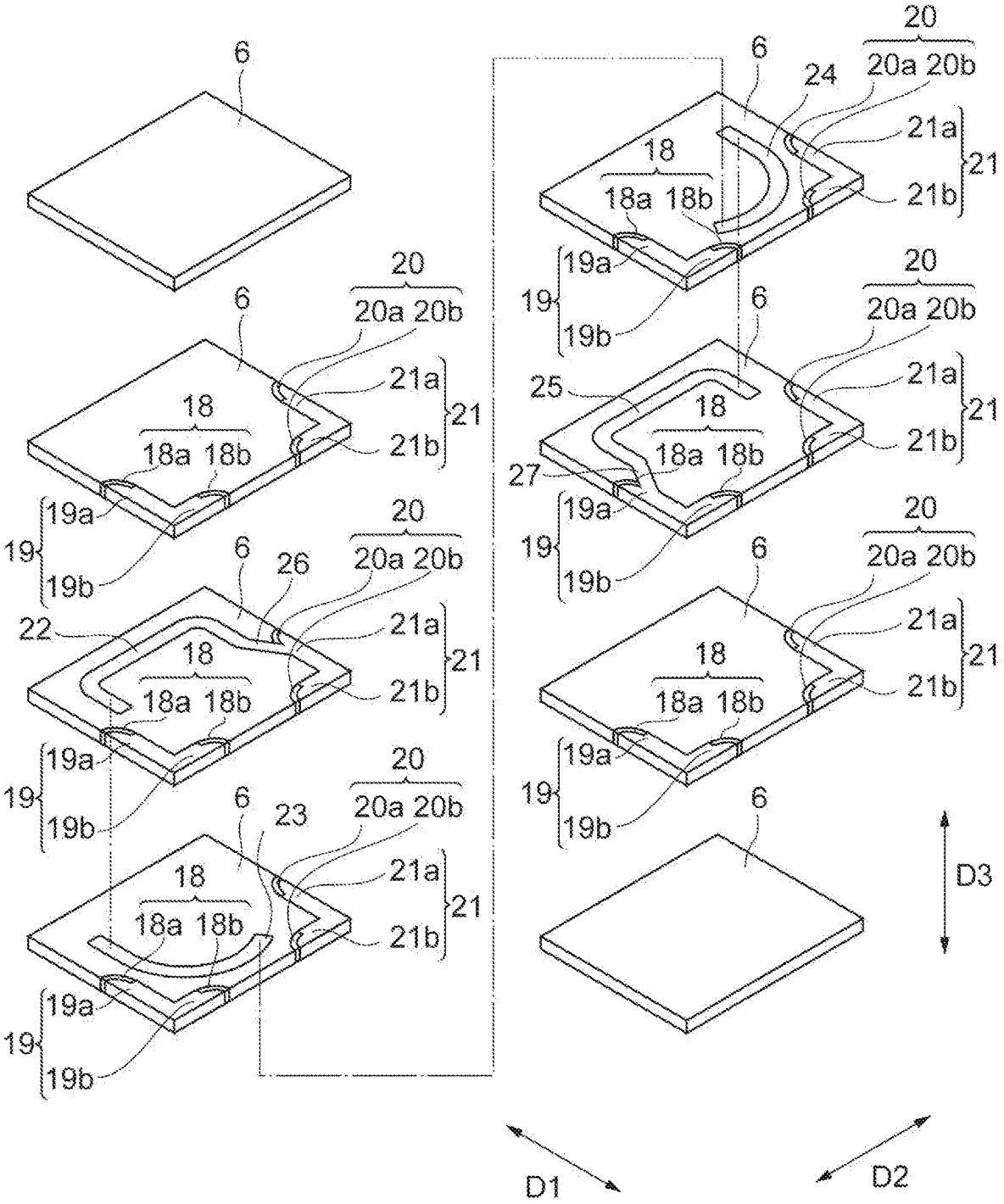
FIG. 11 is an exploded perspective view of the multilayer coil component of FIG. 9.

As illustrated in FIG. 11, the terminal electrode 4B is configured by a plurality of electrode layers 18 and a plurality of electrode layers 19 being stacked. In the present embodiment, the number of the electrode layers 18 is "6" and the number of the electrode layers 19 is "6".

Each electrode layer 18 is provided in a defect portion formed in the insulator layer 6 that corresponds. The defect portion constitutes the recessed portion 7. The electrode layer 18 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. The electrode layer 18 has layer parts 18*a* and 18*b*. The layer part 18*a* and the layer part 18*b* are separated.

Each electrode layer 19 is provided in a defect portion formed in the insulator layer 6 that corresponds. Each electrode layer 19 is positioned in the same insulator layer 6 as each electrode layer 18. The electrode layer 19 is provided in a region outside the electrode layer 18 in the defect portion of the insulator layer 6. The electrode layer 19 is formed by conductive paste being fired. The conductive paste contains a conductive material. The conductive material is, for example, Ag or Pd. Each electrode layer 19 has an L shape when viewed from the third direction D3. The electrode layer 19 has layer parts 19*a* and 19*b*. The layer part 19*a* extends along the first direction D1. The layer part 19*b* extends along the second direction D2.

The electrode part 4Ba is configured by the respective layer parts 18*a* and 19*a* of the electrode layers 18 and 19 being stacked. At the electrode part 4Ba, the layer parts 18*a* and 19*a* are integrated to the extent that the boundary between the layer parts 18*a* and 19*a* is invisible. The electrode part 4Bb is configured by the respective layer parts 18*b* and 19*b* of the electrode layers 18 and 19 being stacked. At the electrode part 4Bb, the layer parts 18*b* and 19*b* are integrated to the extent that the boundary between the layer parts 18*b* and 19*b* is invisible.

As illustrated in FIGS. 10A and 10B, the terminal electrode 4B has a connection region A. The connection region A is a region exposed to the surface of the terminal electrode 4B that faces (comes into contact with) the recessed portion 7 of the element body 2. In the terminal electrode 4B, the connection region A is provided on at least the second surfaces 4Be, 4Bf, 4Bg, 4Bh, 4Bi, and 4Bj facing the side surfaces 7*c*, 7*d*, 7*e*, 7*f*, 7*g*, and 7*h*. In the present embodiment, the connection region A is provided on the first surfaces 4Bc and 4Bd facing the bottom surfaces 7*a* and 7*b* of the recessed portion 7 and the second surfaces 4Be, 4Bf, 4Bg, 4Bh, 4Bi, and 4Bj facing the side surfaces 7*c*, 7*d*, 7*e*, 7*f*, 7*g*, and 7*h*. The connection region A is a region where a compound of elements constituting the element body 2 and a metal component are mixed. In other words, the connection region A contains a glass component. In the present embodiment, the electrode layer 18 constitutes the connection region A.

As illustrated in FIG. 9, the terminal electrode 5B has an L shape when viewed from the third direction D3. The terminal electrode 5B has a plurality of electrode parts 5Ba and 5Bb. In the present embodiment, the terminal electrode 5B has a pair of electrode parts 5Ba and 5Bb. The electrode part 5Ba and the electrode part 5Bb are interconnected in the ridge line portion of the element body 2 and are electrically connected to each other. In the present embodiment, the electrode part 5Ba and the electrode part 5Bb are integrally formed. The electrode part 5Ba extends along the first direction D1. The electrode part 5Ba has a rectangular shape when viewed from the second direction D2. The electrode part 5Bb extends along the second direction D2. The electrode part 5Bb has a rectangular shape when viewed from the first direction D1. Each of the electrode parts 5Ba and 5Bb extends along the third direction D3.

As illustrated in FIGS. 10A and 10B, the terminal electrode 5B has first surfaces 5Bc and 5Bd and second surfaces 5Be, 5Bf, 5Bg, 5Bh, 5Bi, and 5Bj. The first surface 5Bc is a surface facing (coming into contact with) the bottom surface 8*a* of the recessed portion 8 of the element body 2. The first surface 5Bd is a surface facing the bottom surface 8*b* of the recessed portion 8 of the element body 2. The second surface 5Be is a surface facing the side surface 8*c* of the recessed portion 8 of the element body 2. The second surface 5Bf is a surface facing the side surface 8*d* of the recessed portion 8 of the element body 2. The second surface 5Bg is a surface facing the side surface 8*e* of the recessed portion 8 of the element body 2. The second surface 5Bh is a surface facing the side surface 8*f* of the recessed portion 8 of the element body 2. The second surface 5Bi is a surface facing the side surface 8*g* of the recessed portion 8 of the element body 2. The second surface 5Bj is a surface facing the side surface 8*h* of the recessed portion 8 of the element body 2.

As illustrated in FIG. 11, the terminal electrode 5B is configured by a plurality of electrode layers 20 and a plurality of electrode layers 21 being stacked. In the present embodiment, the number of the electrode layers 20 is "6" and the number of the electrode layers 21 is "6".

Each electrode layer 20 is provided in a defect portion formed in the insulator layer 6 that corresponds. The defect portion constitutes the recessed portion 7. The electrode layer 20 is formed by conductive paste being fired. The conductive paste contains a metal component and a glass component. The metal component is contained in a conductive material and is, for example, Ag or Pd. The glass component is a compound of elements constituting the element body 2 and is the same component as the glass component contained in the element body 2. The electrode layer 20 has layer parts 20*a* and 20*b*. The layer part 20*a* and the layer part 20*b* are separated.

Each electrode layer 21 is provided in a defect portion formed in the insulator layer 6 that corresponds. Each electrode layer 21 is positioned in the same insulator layer 6 as each electrode layer 20. The electrode layer 21 is provided in a region outside the electrode layer 20 in the defect portion of the insulator layer 6. The electrode layer 21 is formed by conductive paste being fired. The conductive paste contains a conductive material. The conductive material is, for example, Ag or Pd. Each electrode layer 21 has an L shape when viewed from the third direction D3. The electrode layer 21 has layer parts 21*a* and 21*b*. The layer part 21*a* extends along the first direction D1. The layer part 21*b* extends along the second direction D2.

The electrode part 5Ba is configured by the respective layer parts 20*a* and 21*a* of the electrode layers 20 and 21 being stacked. At the electrode part 5Ba, the layer parts 20*a* and 21*a* are integrated to the extent that the boundary between the layer parts 20*a* and 21*a* is invisible. The electrode part 5Bb is configured by the respective layer parts 20*b* and 21*b* of the electrode layers 20 and 21 being stacked. At the electrode part 5Bb, the layer parts 20*b* and 21*b* are integrated to the extent that the boundary between the layer parts 20*b* and 21*b* is invisible.

As illustrated in FIGS. 10A and 10B, the terminal electrode 5B has a connection region A. The connection region A is a region exposed to the surface of the terminal electrode 5B that faces (comes into contact with) the recessed portion 8 of the element body 2. In the terminal electrode 5B, the connection region A is provided on at least the second surfaces 5Be, 5Bf, 5Bg, 5Bh, 5Bi, and 5Bj facing the side surfaces 8*c*, 8*d*, 8*e*, 8*f*, 8*g*, and 8*h*. In the present embodiment, the connection region A is provided on the first surfaces 5Bc and 5Bd facing the bottom surfaces 8*a* and 8*b* of the recessed portion 8 and the second surfaces 5Be, 5Bf, 5Bg, 5Bh, 5Bi, and 5Bj facing the side surfaces 8*c*, 8*d*, 8*e*, 8*f*, 8*g*, and 8*h*. The connection region A is a region where a compound of elements constituting the element body 2 and a metal component are mixed. In other words, the connection region A contains a glass component. In the present embodiment, the electrode layer 20 constitutes the connection region A.

As described above, in the multilayer coil component 1B according to the present embodiment, the connection region A where a compound of elements constituting the element body 2 and a metal component are mixed is exposed on the second surfaces 4Be, 4Bf, 4Bg, 4Bh, 4Bi, and 4Bj of the terminal electrode 4B. In addition, the connection region A where a compound of elements constituting the element body 2 and a metal component are mixed is exposed on the second surfaces 5Be, 5Bf, 5Bg, 5Bh, 5Bi, and 5Bj of the terminal electrode 5B. In this manner, in the multilayer coil component 1B, the surface of the terminal electrode 4B that comes into contact with the side surfaces 7*c*, 7*d*, 7*e*, 7*f*, 7*g*, and 7*h* of the recessed portion 7 of the element body 2 and the surface of the terminal electrode 5B that comes into contact with the side surfaces 8*c*, 8*d*, 8*e*, 8*f*, 8*g*, and 8*h* of the recessed portion 8 of the element body 2 contain a compound of elements constituting the element body 2, and thus the adhesion strength between the connection region A and the element body 2 is improved. Accordingly, in the multilayer coil component 1B, the adhesion strength between the element body 2 and the second surfaces 4Be, 4Bf, 4Bg, 4Bh, 4Bi, and 4Bj of the terminal electrode 4B and the second surfaces 5Be, 5Bf, 5Bg, 5Bh, 5Bi, and 5Bj of the terminal electrode 5B is improved. Accordingly, in the multilayer coil component 1B, it is possible to suppress the occurrence of peeling at the adhesion part between the side surfaces 7*c*, 7*d*, 7*e*, 7*f*, 7*g*, and 7*h* of the recessed portion 7 of the element body 2 and the terminal electrode 4B and the adhesion part between the side surfaces 8*c*, 8*d*, 8*e*, 8*f*, 8*g*, and 8*h* of the recessed portion 8 and the terminal electrode 5B. As a result, peeling of the terminal electrodes 4B and 5B can be suppressed in the multilayer coil component 1B.

Although the embodiments of the present invention have been described above, the present invention is not necessarily limited to the above-described embodiments and various changes can be made without departing from the gist of the present invention.

In the above-described embodiment, a form in which the connection region A is a region where a glass component as a compound of elements constituting the element body 2 and a metal component are mixed has been described as an example. However, the compound of elements constituting the element body 2 is not limited to the glass component. The compound may be any element constituting the element body 2.

In the above-described embodiment, a form in which the connection region A is exposed to a part of the first surfaces 4*c* and 4*d* and the second surfaces 4*e*, 4*f*, 4*g*, 4*h*, 4*i*, and 4*j* of the terminal electrode 4 in the multilayer coil component 1 has been described as an example. However, the connection region A may be exposed to the entire first surfaces 4*c* and 4*d* and second surfaces 4*e*, 4*f*, 4*g*, 4*h*, 4*i*, and 4*j* of the terminal electrode 4. The same applies to the terminal electrode 5. In addition, the same applies to the multilayer coil components 1A and 1B.

In the above-described embodiment, a form in which the coil 9 has the first coil conductor 22, the second coil conductor 23, the third coil conductor 24, and the fourth coil conductor 25 has been described as an example. However, the number of coil conductors constituting the coil 9 is not limited to the above-described value.

In the above-described embodiment, a form in which the coil axis AX of the coil 9 extends along the third direction D3 has been described as an example. However, the coil axis AX of the coil 9 may extend along the first direction D1. In this case, the direction in which the plurality of insulator layers 6 are stacked coincides with the first direction D1.

In the above-described embodiment, a form in which the terminal electrode 4 has the electrode part 4*a* and the electrode part 4*b* has been described as an example. However, the terminal electrode 4 may have only the electrode part 4*a* or may have only the electrode part 4*b*. Likewise, the terminal electrode 5 may have only the electrode part 5*a* or may have only the electrode part 5*b*. The same applies to the terminal electrodes 4A, 4B, 5A, and 5B.

What is claimed is:

1. A multilayer coil component comprising:

an element body having a plurality of stacked insulator layers and having an outer surface provided with a recessed portion;

a coil disposed in the element body; and a terminal electrode connected to the coil and disposed in the recessed portion, wherein the recessed portion is defined by a bottom surface and a side surface extending in a depth direction of the recessed portion over the outer surface and the bottom surface, the terminal electrode has a first surface facing the bottom surface and a second surface facing the side surface, and a connection region that connects the terminal electrode and the recessed portion, the connection region comprising a mixture of a compound of elements including a material of the element body and a metal component, the connection region being exposed at the second surface.

2. The multilayer coil component according to claim 1, wherein the connection region is exposed at the second surface positioned in both end portions of the terminal electrode in a direction in which the plurality of insulator layers are stacked.

3. The multilayer coil component according to claim 1, wherein the connection region is exposed at the first surface.

4. The multilayer coil component according to claim 2, wherein the connection region is exposed at the first surface.

* * * * *